US011781433B1

(12) United States Patent
Calixtro et al.

(10) Patent No.: US 11,781,433 B1
(45) Date of Patent: Oct. 10, 2023

(54) TURBINE BLADE TIP COOLING HOLE ARRANGEMENT

(71) Applicant: Raytheon Technologies Corporation, Farmington, CT (US)

(72) Inventors: Carlos Calixtro, Atlanta, GA (US); Yanhu Guo, East Hartford, CT (US); Nelson D. Gonzalez, East Hartford, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/077,824

(22) Filed: Dec. 8, 2022

Related U.S. Application Data

(60) Provisional application No. 63/265,895, filed on Dec. 22, 2021.

(51) Int. Cl.
*F01D 5/18* (2006.01)

(52) U.S. Cl.
CPC ..... *F01D 5/186* (2013.01); *F05D 2240/307* (2013.01); *F05D 2250/74* (2013.01); *F05D 2260/202* (2013.01)

(58) Field of Classification Search
CPC . F01D 5/186; F05D 2260/202; F05D 2250/74
See application file for complete search history.

(56) References Cited

U.S. PATENT DOCUMENTS

| | | | | |
|---|---|---|---|---|
| 5,261,789 | A * | 11/1993 | Butts | F01D 5/20 415/115 |
| 5,564,902 | A * | 10/1996 | Tomita | F01D 5/20 415/173.1 |
| 6,602,052 | B2 * | 8/2003 | Liang | F01D 5/18 416/224 |
| 7,704,047 | B2 | 4/2010 | Liang et al. | |
| 8,092,178 | B2 * | 1/2012 | Marini | F01D 5/20 416/97 R |
| 8,277,171 | B2 * | 10/2012 | Kopmels | F01D 5/20 415/115 |
| 10,815,788 | B2 | 10/2020 | Lewis et al. | |
| 2016/0084091 | A1 * | 3/2016 | Papple | F01D 5/186 416/95 |
| 2018/0058224 | A1 * | 3/2018 | Jennings | F02C 3/04 |

* cited by examiner

*Primary Examiner* — Eldon T Brockman
(74) *Attorney, Agent, or Firm* — Kinney & Lange, P. A.

(57) ABSTRACT

A turbine blade for a gas turbine engine includes a plurality of cooling holes positioned adjacent a tip of the turbine blade. The plurality of cooling holes are oriented at specific angles to produce film-cooling of the turbine blade tip to improve durability and performance of the turbine blade. Further, the plurality of cooling holes are positioned at specific locations to improve film-cooling of the turbine blade while reducing negative impacts on performance of the turbine blade.

16 Claims, 4 Drawing Sheets

TURBINE BLADE TIP COOLING HOLE ARRANGEMENT

CROSS-REFERENCE TO RELATED APPLICATION(S)

This application claims the benefit of U.S. Provisional Application No. 63/265,895 filed Dec. 22, 2021, for "TURBINE BLADE TIP COOLING HOLE ARRANGEMENT" is hereby incorporated by reference in its entirety.

BACKGROUND

The present invention relates to turbine blades for use in gas turbine engines and, more particularly, to a cooling hole distribution adjacent a tip of the turbine blade.

A gas turbine engine typically includes a fan section, a compressor section, a combustor section, and a turbine section. Air entering the compressor section is compressed and delivered into the combustion section where it is mixed with fuel and ignited to generate a high-energy gas flow. The high-energy gas flow expands through the turbine section to drive the compressor and the fan section. The compressor section typically includes low-pressure and high-pressure compressors, and the turbine section typically includes low-pressure and high-pressure turbines. Both the compressor and turbine sections include rotating blades alternating between stationary vanes. The stationary vanes and rotating blades in the turbine section extend into the flow path of the high-energy gas flow. As such, the vanes and rotating blades within the gas flow path are exposed to extreme temperatures. A cooling air flow is therefore utilized to produce film-cooling of the turbine blades, improving durability and performance of the turbine blades.

SUMMARY

According to one aspect of the disclosure, a turbine blade for use in a gas turbine engine is disclosed. The turbine blade includes a plurality of cooling holes positioned adjacent a tip of the turbine blade. Each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade. Further, each of the plurality of cooling holes are offset from the tip of the turbine blade by less than 2.0% of a total span between the base of the turbine blade and the tip of the turbine blade.

According to another aspect of the disclosure, a gas turbine engine is disclosed. The gas turbine engine includes a compressor section, a combustor section, and a turbine section. Each section is positioned around a centerline of the gas turbine engine, and the centerline is a central axis of the gas turbine engine. The turbine section includes a plurality of turbine blades configured to rotate about the centerline of the gas turbine engine. Further, at least one of the plurality of turbine blades includes a plurality of cooling holes positioned adjacent a tip of the turbine blade. Each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade. Further, each of the plurality of cooling holes are offset from the tip of the turbine blade by less than 0.55% of a total span between the centerline of the gas turbine engine and the tip of the turbine blade.

DETAILED DESCRIPTION

Figure 1:
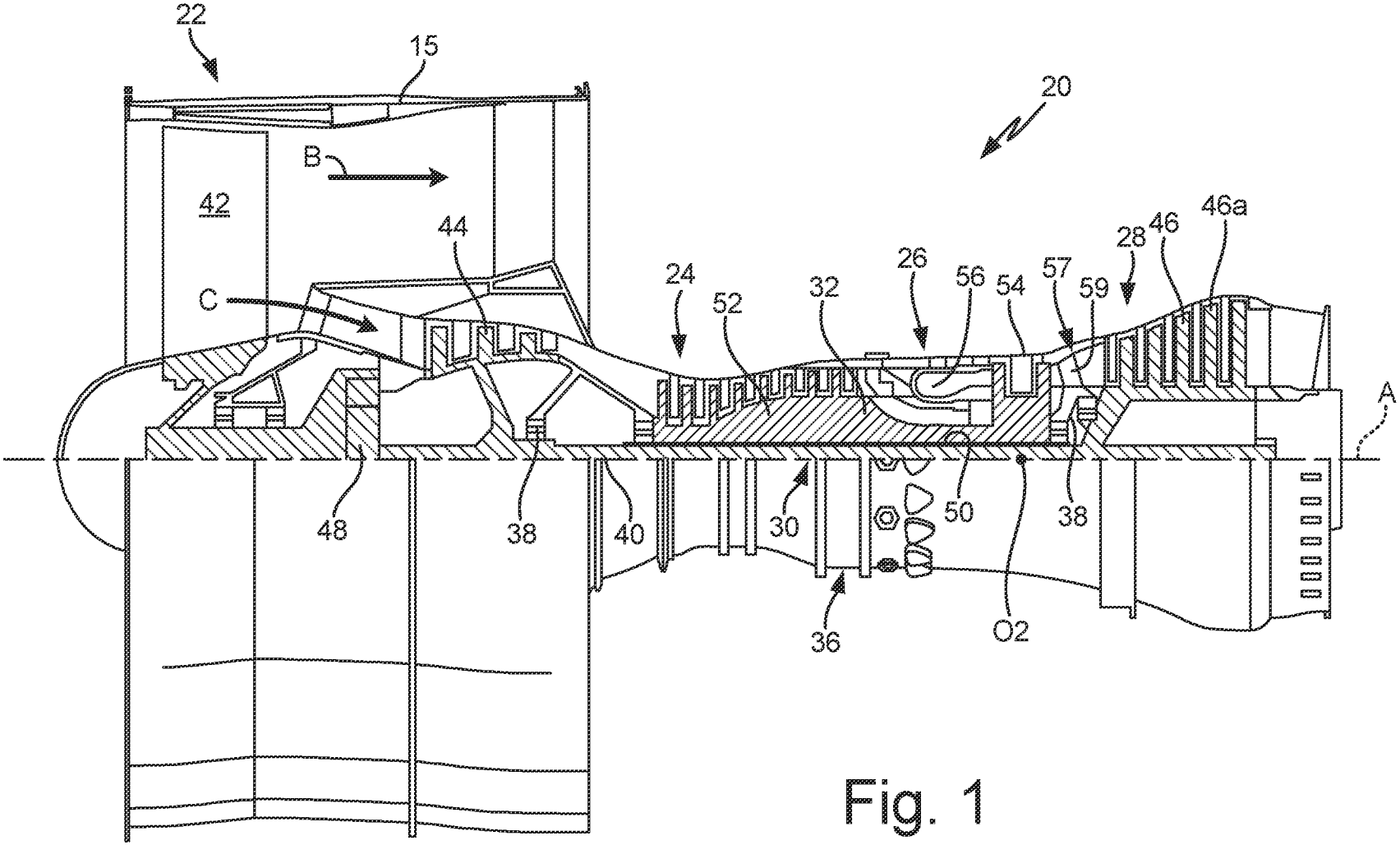
FIG. 1 is a schematic, partial cross-sectional view of a representative gas turbine engine.

FIG. 1 is a schematic, partial cross-sectional view of a representative gas turbine engine 20. Gas turbine engine 20 is disclosed herein as a two-spool turbofan that generally incorporates a fan section 22, a compressor section 24, a combustor section 26, and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low-speed spool 30 and a high-speed spool 32 mounted for rotation about an engine central longitudinal axis A (engine centerline) relative to an engine static structure 36 via several bearing systems 38. It should be understood that various bearing systems 38 at various locations may alternatively or additionally be provided, and the location of bearing systems 38 may be varied as appropriate to the application. The low-speed spool 30 generally includes an inner shaft 40 that interconnects a fan 42, a first or low-pressure compressor 44 and a first or low-pressure turbine 46. The inner shaft 40 is connected to the fan 42 through a speed change mechanism, which in exemplary gas turbine engine 20 is illustrated as a geared architecture 48 to drive the fan 42 at a lower speed than the low-speed spool 30. The high-speed spool 32 includes an outer shaft 50 that interconnects a second or high-pressure compressor 52 and a second or high-pressure turbine 54. A combustor 56 is arranged in exemplary gas turbine 20 between the high-pressure compressor 52 and the high-pressure turbine 54. A mid-turbine frame 57 of the engine static structure 36 is arranged generally between the high-pressure turbine 54 and the low-pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A (engine centerline) which is collinear with their longitudinal axes.

The core airflow is compressed by the low-pressure compressor 44 then the high-pressure compressor 52, mixed and burned with fuel in the combustor 56, then expanded over the high-pressure turbine 54 and low-pressure turbine 46. The mid-turbine frame 57 includes airfoils 59 which are in the core airflow path C. The turbines 46, 54 rotationally drive the respective low speed spool 30 and high-speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Turbine components in a gas turbine engine often require active cooling as temperatures in the gas path exceed the melting point of the constituent components. However, as work is required to pressurize coolant flow prior to being used to cool components, the result of adding cooling flow decreases the efficiency of the turbine. Thus, when designing turbine components, flow must be used sparingly to meet part and module life targets without reducing gas turbine engine performance targets to unacceptable levels.

Figure 2:
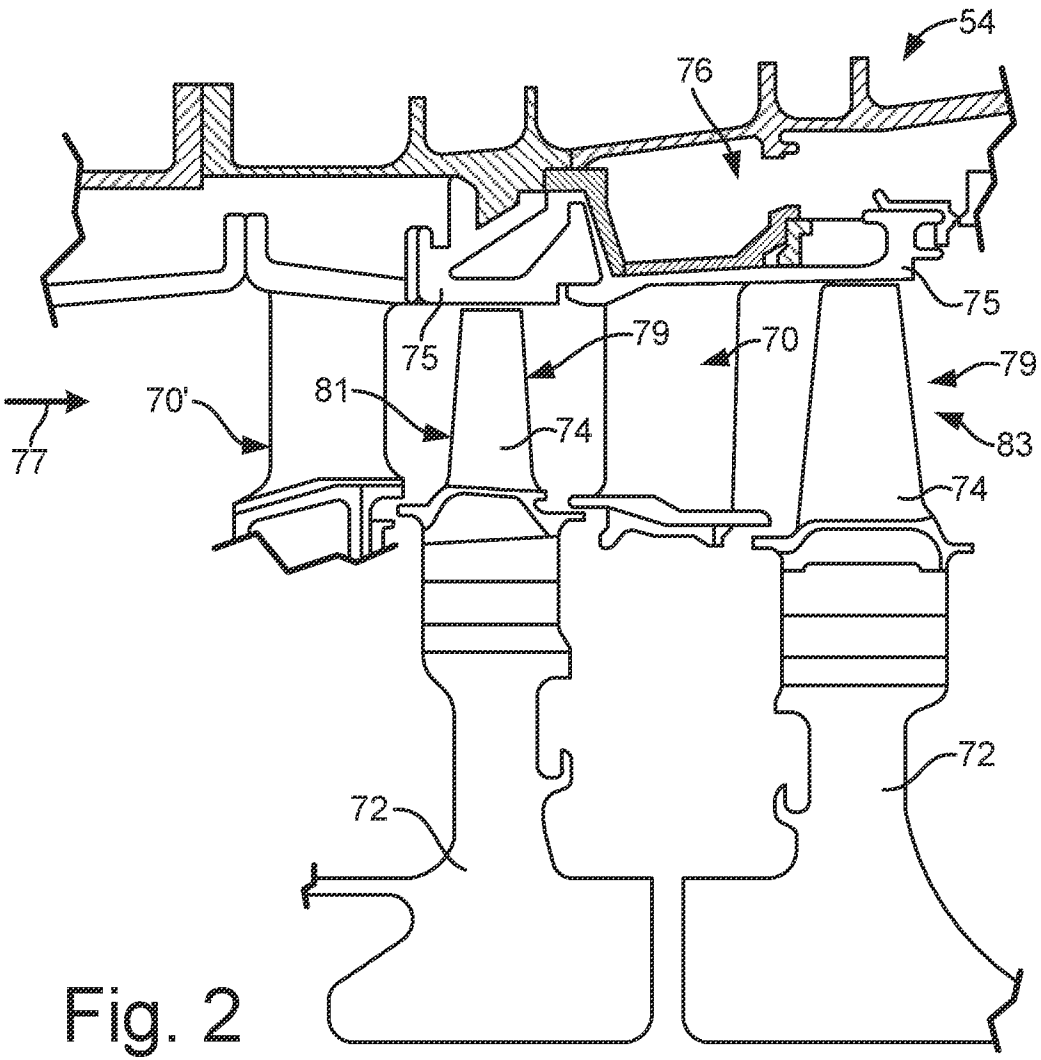
FIG. 2 is a schematic view of a two-stage high pressure turbine of the gas turbine engine.

FIG. 2 illustrates a portion of the high-pressure turbine (HPT) 54. FIG. 2 also illustrates high-pressure turbine stage vanes 70 one of which (e.g., first stage vane 70') is located forward of a first one of a pair of turbine disks 72 each having a plurality of turbine blades 74 secured thereto. Turbine blades 74 rotate proximate blade outer air seals (BOAS) 75 which are located aft of vane 70 or first stage vane 70'. The other vane 70 is located between the pair of turbine disks 72, this vane 70 may be referred to as the second stage vane. As used herein first stage vane 70' is the first vane of high-pressure turbine section 54 that is located aft of combustor section 26 and second stage vane 70 is located aft of first stage vane 70' and is located between the pair of turbine disks 72. In addition, blade outer air seals (BOAS) 75 are disposed between first stage vane 70' and second stage vane 70. The high-pressure turbine stage vane 70 (e.g., second stage vane) is one of a plurality of vanes 70 that are positioned circumferentially about the axis A (engine centerline) of the engine in order to provide stator assembly 76. Hot gases from combustor section 26 flow through the turbines in the direction of arrow 77. Although a two-stage high pressure turbine is illustrated, other high-pressure turbines are considered to be within the scope of various embodiments of the present disclosure.

High-pressure turbine (HPT) 54 is subjected to gas temperatures well above the yield capability of its material. In order to mitigate detrimental effects due to such high temperature, surface film-cooling is typically used to cool the blades and vanes of the high-pressure turbine. Surface film-cooling is achieved by supplying cooling air from the relatively cold (compared to the temperature of the gas temperatures) interior or backside of the turbine blade through cooling holes formed on the high-pressure turbine components. Cooling holes are strategically designed and placed on the vane and turbine components in-order to maximize the cooling effectiveness and minimize the efficiency penalty.

Turbine blade 74 illustrated in FIG. 2 includes cooling holes for producing the desired surface film-cooling. As discussed, turbine blades 74 are secured to turbine disk 72 that is configured to rotate about axis A (engine centerline). Turbine disk 72 and its attached turbine blades 74 may be referred to as turbine rotor assembly 79. Turbine blades 74 and their associated disks 72 are located behind or downstream from first stage vane 70' and the second stage vane 70. The turbine blades located behind or downstream from first stage vane 70' and in front of second stage vane 70 may be referred to as first stage turbine blades 81. The turbine blades located behind or downstream from second stage vane 70 may be referred to as second stage turbine blades 83. The following discussion regarding turbine blade 74 should be understood to apply equally to both first stage turbine blades 81 and second stage turbine blade 83.

Referring to FIGS. 3A-3D, turbine blade 74 includes airfoil 84, platform 86, and root 88. Airfoil 84 is coupled to platform 86 at one end and airfoil 84 includes tip 90 that terminates at the other end of airfoil 84, opposite platform 86. Airfoil 84 extends radially outward from platform 86, with respect to axis A (FIG. 1), such that tip 90 of airfoil 84 is at a further radial distance from axis A than platform 86. Root 88 is coupled to platform 86 and root 88 extends radially inward from platform 86, with respect to axis A, such that root 88 is at a closer radial distance to axis A than platform 86. Root 88 is used to secure turbine blade 74 to turbine disk 72. Root 88 includes base 92, which is the innermost surface of root 88 and turbine blade 74. In other words, base 92 is a surface of root 88 that is positioned closer to axis A than any other feature of turbine blade 74. In contrast, tip 90 of airfoil 84 is positioned farther from axis A than any other feature of turbine blade 74. In one embodiment, airfoil 84 may be integrally formed or cast with platform 86 and/or root 88. In other words, turbine blade 74 including airfoil 84, platform 86, and root 88 may be cast as a single part.

Airfoil 84 includes leading edge 94, trailing edge 96, pressure-side sidewall 98, suction-side sidewall 100, and internal cavities that are in fluid communication with a source of cooling air or fluid. Leading edge 94 is the forward or upstream edge of turbine blade 74, with respect to the flow direction through engine 20. Trailing edge 96 is the rear or downstream edge of turbine blade 74, with respect to the flow direction through engine 20. Pressure-side sidewall 98 and suction-side sidewall 100 each extend between leading edge 94 and trailing edge 96. Airfoil 84 also includes a plurality of cooling openings or film cooling holes that are in fluid communication with the internal cavities in order to provide a source of cooling fluid or air to portions of airfoil 84, such that film cooling can be provided at desired locations.

Figure 3B:
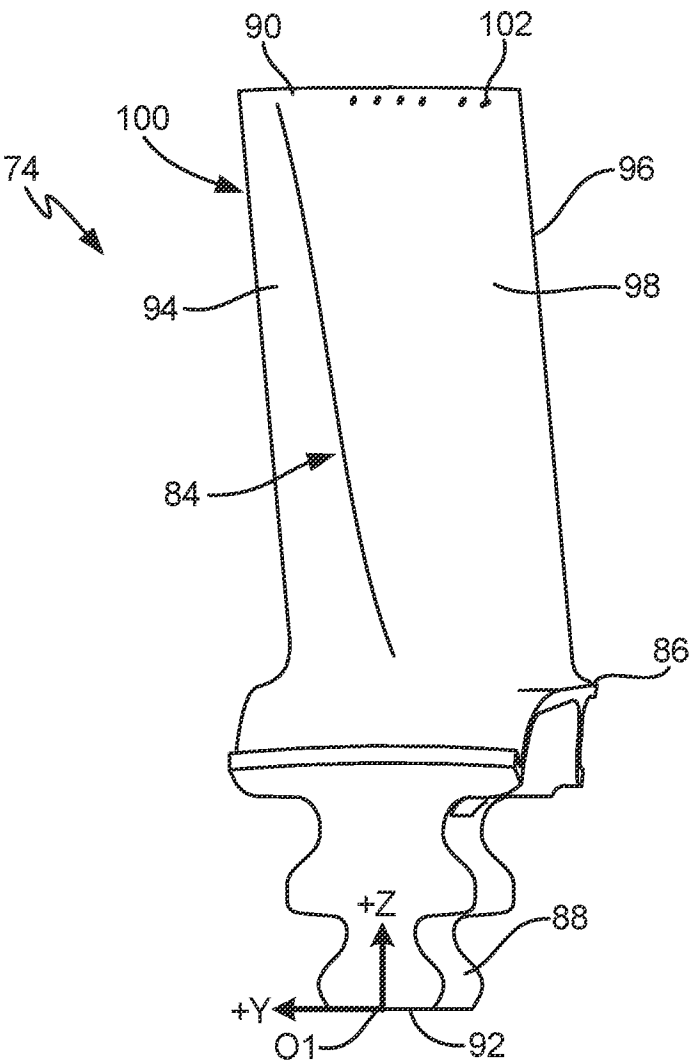
FIG. 3B is a first perspective view of the turbine blade of FIG. 3A.
Figure 3A:
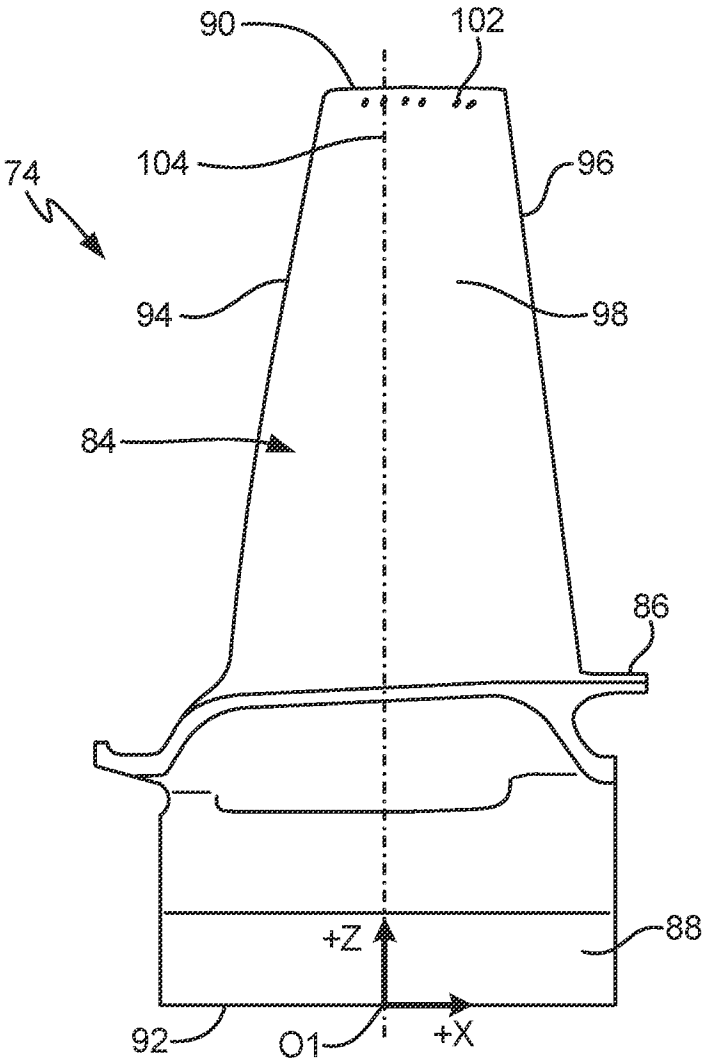
FIG. 3A is a side view of a turbine blade of the gas turbine engine.
Figure 3C:
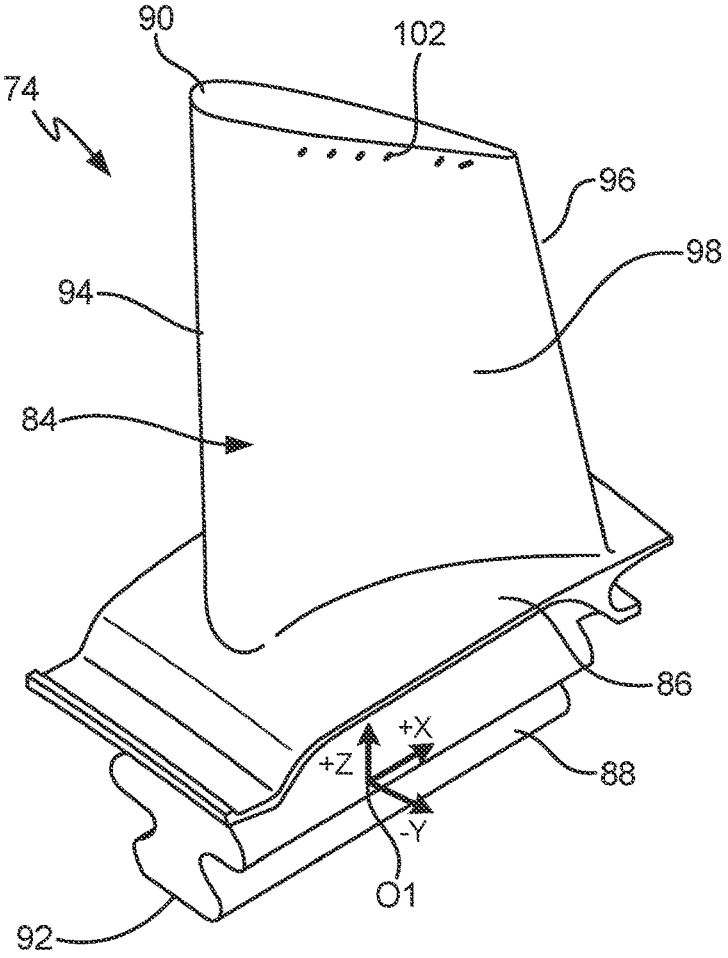
FIG. 3C is a second perspective view of the turbine blade of FIG. 3A.
Figure 3D:
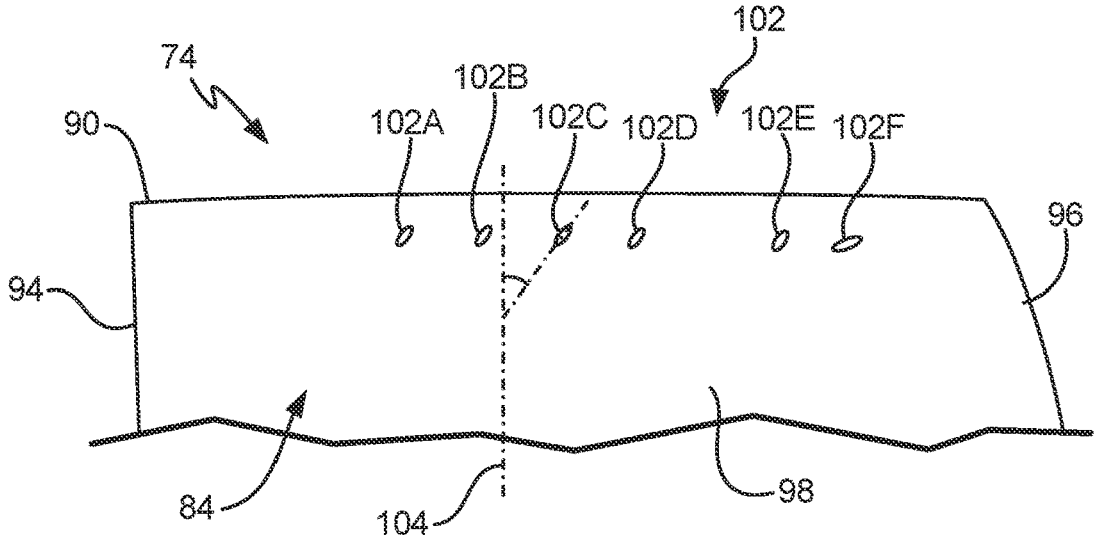
FIG. 3D is a closeup side view of a tip of the turbine blade of FIG. 3A.

As shown best in FIG. 3D, adjacent tip 90 of airfoil 84 a plurality of cooling holes 102 extend from the interior or backside surface of turbine blade 74 to the exterior gas path side of turbine blade 74. More specifically, each of the plurality of cooling holes 102 extend from an interior of turbine blade 74 through pressure-side sidewall 98 to an exterior of turbine blade 74. As such, each of the plurality of cooling holes 102 are fluidly coupled to the internal cavities within airfoil 84 and each of the plurality of cooling holes 102 are configured to receive cooling flow from the cooling source. Further, each of the plurality of cooling holes 102 extend through pressure-side sidewall 98 towards trailing edge 96 of turbine blade 74 at an acute angle, with respect to vertical axis 104 extending from base 92 of root 88 of turbine blade 74 to tip 90 of airfoil 84 of turbine blade 74 (FIG. 3A). In the embodiment shown, the plurality of cooling holes 102 are positioned within the second stage turbine blade of the high-pressure turbine of the gas turbine engine. In another embodiment, the plurality of cooling holes 102 can be positioned within any vane or blade of the gas turbine engine.

In the example shown in FIGS. 3A-3D, the plurality of cooling holes 102 includes a total of six cooling holes 102 adjacent tip 90 of airfoil 84, including first cooling hole 102A, second cooling hole 102B, third cooling hole 102C, fourth cooling hole 102D, fifth cooling hole 102E, and sixth cooling hole 102F. In other words, in the example shown, the plurality of cooling holes 102 consists of six cooling holes, such that first cooling hole 102A, second cooling hole 102B, third cooling hole 102C, fourth cooling hole 102D, fifth cooling hole 102E, and sixth cooling hole 102D are the only cooling holes 102 within pressure-side sidewall 98 of turbine blade 74. As labelled and described, first cooling hole 102A is the cooling hole closest to leading edge 94 and sixth cooling hole 102F is the cooling hole closest to trailing edge 96, and second cooling hole 102B through fifth cooling hole 102E are in sequential order between the first cooling hole 102A and sixth cooling hole 102F. Each of the plurality of cooling holes 102 can have a diameter ranging between 0.010 inches (0.254 mm) and 0.020 inches (0.508 mm). Further, each of the plurality of cooling holes 102 are spaced apart from each other by a distance. In the example shown, the spacing between first cooling hole 102A and second cooling hole 102B, the spacing between second cooling hole 102B and third cooling hole 102C, and the spacing between third cooling hole 102C and fourth cooling hole 102D are substantially equal values. In some examples, the center-to-center spacing between cooling holes 102A, 102B, 102C, and 102D can each range between 0.050 inches (1.27 mm) and 0.100 inches (2.54 mm), respectively. In contrast, the spacing between fourth cooling hole 102D and fifth cooling hole 102E is larger than a spacing between third cooling hole 102C and fourth cooling hole 102D. The spacing of cooling holes 102 can vary depending on the desired cooling characteristics and the internal geometry of turbine blade 84. For example, cooling holes 102 may be spaced to avoid interference with air flow tubulating features within the interior of turbine blade 84 to increase the cooling flow characteristics of the cooling air flowing with the interior of turbine blade 84.

Further, as discussed, each of cooling holes 102 extend towards trailing edge 96 of turbine blade 74 at an acute angle, with respect to vertical axis 104 extending from base 92 to tip 90 of turbine blade 74. More specifically, first cooling hole 102A, second cooling hole 102B, third cooling hole 102C, fourth cooling hole 102D, and fifth cooling hole 102E extend toward trailing edge 96 of turbine blade 74 at an angle ranging between 25 degrees and 30 degrees with respect to vertical axis 104 (the angle is measured from vertical axis 104 to a central axis of each cooling hole 102). In addition, sixth cooling hole 102F extends toward trailing edge 96 of turbine blade 74 at an angle ranging between 55 degrees and 60 degrees with respect to vertical axis 104 (the angle is measured from vertical axis 104 to a central axis of sixth cooling hole 102F). As such, cooling holes 102 are configured to dispense cooling air or another cooling fluid adjacent tip 90 of turbine blade 74 to cool turbine blade 74.

In some examples, each of the plurality of cooling holes can be offset from tip 90 of turbine blade 74 by less than 2.0% of a total span between base 92 of turbine blade 74 and tip 90 of turbine blade 74. In other words, the total span of turbine blade 74 is the distance between base 92 and tip 90 of turbine blade 74. The location in which a center of each of the plurality of cooling holes 102 extends through turbine blade 74 is offset from tip 90 by no more than 2.0% of the total span of turbine blade 74. Further, the plurality of cooling holes 102 can be located in turbine blade 74 according to coordinates of Table 1, shown below. Table 1 discloses non-dimensionalized distances from origin O1 on turbine blade 74 based on a Cartesian X, Y, Z coordinate system as shown in the figures. More specifically, the X, Y, and Z axes respectively correspond to the axial (X), circumferential (Y) and radial (Z) directions as shown in the figures. In the example shown, origin O1 is located at a center point of base 92 of turbine blade 74. In other words, origin O1 is located on base 92 of turbine blade 74 and at an equal distance between leading edge 94 and trailing edge 96 of turbine blade 74. The non-dimensionalized distances are scaled distances based on the total span between base 92 and tip 90 of turbine blade 74. As such, turbine blades 74 of varying sizes can include cooling holes 102 as described in Table 1 and the coordinates are not limited to a single turbine blade. Due to manufacturing tolerances, cooling holes 102 may have a diametrical surface tolerance, relative to the specified coordinates, of 0.20 inches (5.08 mm).

TABLE 1

| Cooling Hole | X-Coordinate | Y-Coordinate | Z-Coordinate |
|---|---|---|---|
| First cooling hole 102A | −0.02603 | 0.051488 | 0.98781 |
| Second cooling hole 102B | −0.00588 | 0.026176 | 0.987801 |
| Third cooling hole 102C | 0.015465 | 0.001467 | 0.987804 |
| Fourth cooling hole 102D | 0.034776 | −0.02092 | 0.98688 |
| Fifth cooling hole 102E | 0.072769 | −0.06597 | 0.985947 |
| Sixth cooling hole 102F | 0.088683 | −0.0881 | 0.984446 |

As such, in one embodiment, turbine blade 74 can comprise a plurality of cooling holes 102 in the locations defined by Table 1. Cooling holes 102 may be circular or conical in shape, and each cooling hole 102 may not have the same shape. Of course, other numerous configurations are considered to be within the scope of various embodiments of the present disclosure. In one embodiment, cooling holes 102 (Table 1) may also be used in combination with other cooling holes located throughout turbine blade 74. These other cooling holes may be located on any combination of the leading edge 94, trailing edge 96, tip 90, platform 86, pressure-side sidewall 98, and suction-side sidewall 100 of turbine blade 74. Alternatively, turbine blade 74 may be formed with only the cooling hole locations identified in Table 1.

In other examples, each of the plurality of cooling holes can be offset from tip 90 of turbine blade 74 by less than 0.55% of a total span between axis A (engine centerline) of engine 20 and tip 90 of turbine blade 74. In other words, the total span in this example is defined as the distance between axis A (engine centerline) of engine 20 and tip 90 of turbine blade 74. The location in which a center of each of the plurality of cooling holes 102 extends through turbine blade 74 is offset from tip 90 by no more than 0.55% of the total span between axis A and tip 90. Further, the plurality of cooling holes 102 can be located in turbine blade 74 according to coordinates of Table 2, shown below. Table 2 discloses non-dimensionalized distances from origin O2 (FIG. 1) of engine 20 based on a Cartesian X, Y, Z coordinate system as shown in the figures. More specifically, the X, Y, and Z axes respectively correspond to the axial (X), circumferential (Y) and radial (Z) directions as shown in the figures. In the example shown, origin O2 is located at the centerline (axis A) of gas turbine engine 20 and at a location an equal distance between leading edge 94 and trailing edge 96 of turbine blade 74. The non-dimensionalized distances are scaled distances based on the total span between axis A of engine 20 and tip 90 of turbine blade 74. As such, turbine blades 74 of varying sizes can include cooling holes 102 as described in Table 2 and the coordinates are not limited to a single turbine blade. Due to manufacturing tolerances, cooling holes 102 may have a diametrical surface tolerance, relative to the specified coordinates, of 0.20 inches (5.08 mm).

TABLE 2

| Cooling Hole | X-Coordinate | Y-Coordinate | Z-Coordinate |
|---|---|---|---|
| First cooling hole 102A | −0.0088 | 0.0174 | 0.9959 |
| Second cooling hole 102B | −0.0020 | 0.0088 | 0.9959 |
| Third cooling hole 102C | 0.0052 | 0.0005 | 0.9959 |
| Fourth cooling hole 102D | 0.0117 | −0.0071 | 0.9956 |
| Fifth cooling hole 102E | 0.0246 | −0.0223 | 0.9953 |
| Sixth cooling hole 102F | 0.0300 | −0.0298 | 0.9947 |

As such, in another embodiment, the turbine blade 74 can comprise a plurality of cooling holes 102 in the locations defined by Table 2. Cooling holes 102 may be circular or conical in shape, and each cooling hole 102 may not have the same shape. Of course, other numerous configurations are considered to be within the scope of various embodiments of the present disclosure. In one embodiment, cooling holes 102 (Table 2) may also be used in combination with other cooling holes located throughout turbine blade 74. These other cooling holes may be located on any combination of the leading edge 94, trailing edge 96, tip 90, platform 86, pressure-side sidewall 98, and suction-side sidewall 100 of turbine blade 74. Alternatively, turbine blade 74 may be formed with only the cooling hole locations identified in Table 2.

Cooling holes 102 are arranged to produce boundary layers of cooling fluid on the gas path side of the external surfaces of the airfoil 84 adjacent tip 90. Cooling holes 102 can be diffusing holes or cylindrical holes, for example, but are not limited to such geometries. In diffusing hole geometries, the hole area increases as the hole opens to the external surface (i.e., conical shaped holes). Cylindrical holes have a uniform diameter area along the length of the hole. In further examples, a portion of the film cooling holes 102 are cylindrical holes and another portion are diffusing holes. Cooling holes 102 are configured to dispense cooling air flow adjacent tip 90, which is utilized to produce film-cooling of turbine blades 74, improving durability and performance of the turbine blades. More specifically, cooling holes 102 are configured to dispense cooling airflow along tip 90 of turbine blade 74 to cool tip 90 during operation of the gas turbine engine. Cooling tip 90 of turbine blade 74 prevents tip 90 from melting and/or deforming due to the heat produced during operation of the gas turbine engine. As such, cooling holes 102 improve the durability and performance of turbine blade 74 (and the gas turbine engine) by preventing heat related damages to tip 90 of turbine blade 74 during operation of the gas turbine engine.

DISCUSSION OF POSSIBLE EMBODIMENTS

The following are non-exclusive descriptions of possible embodiments of the present invention.

A turbine blade for use in a gas turbine engine, the turbine blade comprising: a plurality of cooling holes positioned adjacent a tip of the turbine blade; wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade; and wherein each of the plurality of cooling holes are offset from the tip of the turbine blade by less than 2.0% of a total span between the base of the turbine blade and the tip of the turbine blade.

The turbine blade of the preceding paragraph can optionally include, additionally and/or alternatively, any one or more of the following features, configurations and/or additional components:

The plurality of cooling holes comprises six cooling holes, including a first cooling hole, a second cooling hole, a third cooling hole, a fourth cooling hole, a fifth cooling hole, and a sixth cool hole.

The first cooling hole extends toward the trailing edge of the turbine blade at an angle ranging between 25 degrees and 30 degrees with respect to the vertical axis; the second cooling hole extends toward the trailing edge of the turbine blade at an angle ranging between 25 degrees and 30 degrees with respect to the vertical axis; the third cooling hole extends toward the trailing edge of the turbine blade at an angle ranging between 25 degrees and 30 degrees with respect to the vertical axis; the fourth cooling hole extends toward the trailing edge of the turbine blade at an angle ranging between 25 degrees and 30 degrees with respect to the vertical axis; the fifth cooling hole extends toward the trailing edge of the turbine blade at an angle ranging between 25 degrees and 30 degrees with respect to the vertical axis; and the sixth cooling hole extends toward the trailing edge of the turbine blade at an angle ranging between 55 degrees and 60 degrees with respect to the vertical axis.

A spacing between the first cooling hole and the second cooling hole, a spacing between the second cooling hole and the third cooling hole, and a spacing between the third cooling hole and the fourth cooling hole are equal values; and a spacing between the fourth cooling hole and the fifth cooling hole is larger than the spacing between the third cooling hole and the fourth cooling hole.

Each of the plurality of cooling holes extend through the turbine blade pressure-side sidewall to a flow channel within the interior of the turbine blade such that the plurality of cooling holes are fluidly coupled to the flow channel.

The plurality of cooling holes are located in the turbine blade according to coordinates of Table 1, wherein the coordinates of Table 1 are non-dimensionalized distances from a point of origin on the turbine blade based on the total span between the base of the turbine blade and the tip of the turbine blade, the point of origin being located at a center point of the base of the turbine blade.

A platform, an airfoil extending from the platform, and a root, wherein the platform, the root, and the airfoil are cast as a single part.

The plurality of cooling holes are positioned within the airfoil of the turbine blade, and wherein the plurality of cooling holes are produced after a casting process.

At least some of the plurality of cooling holes have a diameter ranging between 0.010 inches (0.254 mm) and 0.020 inches (0.508).

The turbine blade is a second stage turbine blade of a high-pressure turbine of the gas turbine engine.

The following are further non-exclusive descriptions of possible embodiments of the present invention.

A gas turbine engine comprising: compressor section, a combustor section, and a turbine section, each positioned around a centerline of the gas turbine engine, wherein the centerline is a central axis of the gas turbine engine; the turbine section comprises a plurality of turbine blades configured to rotate about the centerline of the gas turbine engine, wherein at least one of the plurality of turbine blades comprises: a plurality of cooling holes positioned adjacent a tip of the turbine blade; wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade; and wherein each of the plurality of cooling holes are offset from the tip of the turbine blade by less than 0.55% of a total span between the centerline of the gas turbine engine and the tip of the turbine blade.

The gas turbine engine of the preceding paragraph can optionally include, additionally and/or alternatively, any one or more of the following features, configurations and/or additional components:

The plurality of cooling holes comprises six cooling holes, including a first cooling hole, a second cooling hole, a third cooling hole, a fourth cooling hole, a fifth cooling hole, and a sixth cool hole.

The first cooling hole extends toward the trailing edge of the turbine blade at an angle ranging between 25 degrees and 30 degrees with respect to the vertical axis; the second cooling hole extends toward the trailing edge of the turbine blade at an angle ranging between 25 degrees and 30 degrees with respect to the vertical axis; the third cooling hole extends toward the trailing edge of the turbine blade at an angle ranging between 25 degrees and 30 degrees with respect to the vertical axis; the fourth cooling hole extends toward the trailing edge of the turbine blade at an angle ranging between 25 degrees and 30 degrees with respect to the vertical axis; the fifth cooling hole extends toward the trailing edge of the turbine blade at an angle ranging between 25 degrees and 30 degrees with respect to the vertical axis; and the sixth cooling hole extends toward the trailing edge of the turbine blade at an angle ranging between 55 degrees and 60 degrees with respect to the vertical axis.

A spacing between the first cooling hole and the second cooling hole, a spacing between the second cooling hole and the third cooling hole, and a spacing between the third cooling hole and the fourth cooling hole are equal values; and a spacing between the fourth cooling hole and the fifth cooling hole is larger than the spacing between the third cooling hole and the fourth cooling hole.

The turbine blade further comprises a platform, an airfoil extending from the platform, and a root, wherein the platform, the root, and the airfoil are cast as a single part, and wherein the plurality of cooling holes are positioned within the airfoil of the turbine blade and the plurality of cooling holes are produced after a casting process.

Each of the plurality of cooling holes extend through the turbine blade pressure-side sidewall to a flow channel within the interior of the turbine blade such that the plurality of cooling holes are fluidly coupled to the flow channel.

The plurality of cooling holes are located in the turbine blade according to coordinates of Table 2, wherein the coordinates of Table 2 are non-dimensionalized distances from a point of origin within the gas turbine engine based on a total span between the centerline of the gas turbine engine and the tip of the turbine blade, the point of origin being located at the centerline of the gas turbine engine and at a location an equal distance between a leading edge and a trailing edge of the turbine blade.

At least some of the plurality of cooling holes have a diameter ranging between 0.010 inches (0.254) and 0.020 inches (0.508 mm).

The turbine blade is a second stage turbine blade of a high-pressure turbine of the gas turbine engine.

A turbine blade for use in a gas turbine engine, the turbine blade comprising: a plurality of cooling holes located within the turbine blade according to coordinates of Table 1; wherein the coordinates of Table 1 are non-dimensionalized distances from a point of origin on the turbine blade based on a total span between a base of the turbine blade and a tip of the turbine blade; and wherein the point of origin is located at a center point of the base of the turbine blade.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine blade for use in a gas turbine engine, the turbine blade comprising:

a plurality of cooling holes positioned adjacent a tip of the turbine blade, wherein the plurality of cooling holes comprises six cooling holes, including a first cooling hole, a second cooling hole, a third cooling hole, a fourth cooling hole, a fifth cooling hole, and a sixth cooling hole;

wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade;

wherein each of the plurality of cooling holes are offset from the tip of the turbine blade by less than 2.0% of a total span between the base of the turbine blade and the tip of the turbine blade; and wherein:

the first cooling hole extends toward the trailing edge of the turbine blade at an angle ranging between 25 degrees and 30 degrees with respect to the vertical axis;

the second cooling hole extends toward the trailing edge of the turbine blade at an angle ranging between 25 degrees and 30 degrees with respect to the vertical axis;

the third cooling hole extends toward the trailing edge of the turbine blade at an angle ranging between 25 degrees and 30 degrees with respect to the vertical axis;

the fourth cooling hole extends toward the trailing edge of the turbine blade at an angle ranging between 25 degrees and 30 degrees with respect to the vertical axis;

the fifth cooling hole extends toward the trailing edge of the turbine blade at an angle ranging between 25 degrees and 30 degrees with respect to the vertical axis; and the sixth cooling hole extends toward the trailing edge of the turbine blade at an angle ranging between 55 degrees and 60 degrees with respect to the vertical axis.

2. The turbine blade of claim 1, wherein the plurality of cooling holes consists of six cooling holes, such that a first cooling hole, a second cooling hole, a third cooling hole, a fourth cooling hole, a fifth cooling hole, and a sixth cooling hole are the only cooling holes within the pressure-side sidewall of the turbine blade.

3. The turbine blade of claim 1, wherein each of the plurality of cooling holes extend through the turbine blade pressure-side sidewall to a flow channel within the interior of the turbine blade such that the plurality of cooling holes are fluidly coupled to the flow channel.

4. The turbine blade of claim 1 and further comprising a platform, an airfoil extending from the platform, and a root, wherein the platform, the root, and the airfoil are cast as a single part.

5. The turbine blade of claim 4, wherein the plurality of cooling holes are positioned within the airfoil of the turbine blade, and wherein the plurality of cooling holes are produced after a casting process.

6. The turbine blade of claim 1, wherein at least some of the plurality of cooling holes have a diameter ranging between 0.010 inches (0.254 mm) and 0.020 inches (0.508 mm).

7. A gas turbine engine comprising:

a compressor section, a combustor section, and a turbine section, each positioned around a centerline of the gas turbine engine, wherein the centerline is a central axis of the gas turbine engine;

the turbine section comprises a plurality of turbine blades configured to rotate about the centerline of the gas turbine engine, wherein at least one of the plurality of turbine blades comprises:

a plurality of cooling holes positioned adjacent a tip of the turbine blade, wherein the plurality of cooling holes comprises six cooling holes, including a first cooling hole, a second cooling hole, a third cooling hole, a fourth cooling hole, a fifth cooling hole, and a sixth cooling hole;

wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade;

wherein each of the plurality of cooling holes are offset from the tip of the turbine blade by less than 0.55% of a total span between the centerline of the gas turbine engine and the tip of the turbine blade; and wherein:

the first cooling hole extends toward the trailing edge of the turbine blade at an angle ranging between 25 degrees and 30 degrees with respect to the vertical axis;

the second cooling hole extends toward the trailing edge of the turbine blade at an angle ranging between 25 degrees and 30 degrees with respect to the vertical axis;

the third cooling hole extends toward the trailing edge of the turbine blade at an angle ranging between 25 degrees and 30 degrees with respect to the vertical axis;

the fourth cooling hole extends toward the trailing edge of the turbine blade at an angle ranging between 25 degrees and 30 degrees with respect to the vertical axis;

the fifth cooling hole extends toward the trailing edge of the turbine blade at an angle ranging between 25 degrees and 30 degrees with respect to the vertical axis; and the sixth cooling hole extends toward the trailing edge of the turbine blade at an angle ranging between 55 degrees and 60 degrees with respect to the vertical axis.

8. The gas turbine engine of claim 7, wherein the turbine blade further comprises a platform, an airfoil extending from the platform, and a root, wherein the platform, the root, and the airfoil are cast as a single part, and wherein the plurality of cooling holes are positioned within the airfoil of the turbine blade and the plurality of cooling holes are produced after a casting process.

9. The gas turbine engine of claim 7, wherein each of the plurality of cooling holes extend through the turbine blade pressure-side sidewall to a flow channel within the interior of the turbine blade such that the plurality of cooling holes are fluidly coupled to the flow channel.

10. The gas turbine engine of claim 7, wherein at least some of the plurality of cooling holes have a diameter ranging between 0.010 inches (0.254) and 0.020 inches (0.508 mm).

11. The gas turbine engine of claim 7, wherein the turbine blade is a second stage turbine blade of a high-pressure turbine of the gas turbine engine.

12. A turbine blade for use in a gas turbine engine, the turbine blade comprising:

a plurality of cooling holes located within the turbine blade according to coordinates of Table 1;

wherein the coordinates of Table 1 are non-dimensionalized distances from a point of origin on the turbine blade based on a total span between a base of the turbine blade and a tip of the turbine blade; and wherein the point of origin is located at a center point of the base of the turbine blade.

13. A turbine blade for use in a gas turbine engine, the turbine blade comprising:

a plurality of cooling holes positioned adjacent a tip of the turbine blade; wherein the plurality of cooling holes comprises six cooling holes, including a first cooling hole, a second cooling hole, a third cooling hole, a fourth cooling hole, a fifth cooling hole, and a sixth cooling hole;

wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade;

wherein each of the plurality of cooling holes are offset from the tip of the turbine blade by less than 2.0% of a total span between the base of the turbine blade and the tip of the turbine blade; and wherein:

a spacing between the first cooling hole and the second cooling hole, a spacing between the second cooling hole and the third cooling hole, and a spacing between the third cooling hole and the fourth cooling hole are equal values; and a spacing between the fourth cooling hole and the fifth cooling hole is larger than the spacing between the third cooling hole and the fourth cooling hole.

14. A turbine blade for use in a gas turbine engine, the turbine blade comprising:

a plurality of cooling holes positioned adjacent a tip of the turbine blade;

wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade;

wherein each of the plurality of cooling holes are offset from the tip of the turbine blade by less than 2.0% of a total span between the base of the turbine blade and the tip of the turbine blade; and wherein the plurality of cooling holes are located in the turbine blade according to coordinates of Table 1, wherein the coordinates of Table 1 are non-dimensionalized distances from a point of origin on the turbine blade based on the total span between the base of the turbine blade and the tip of the turbine blade, the point of origin being located at a center point of the base of the turbine blade.

15. A gas turbine engine comprising:

a compressor section, a combustor section, and a turbine section, each positioned around a centerline of the gas turbine engine, wherein the centerline is a central axis of the gas turbine engine;

the turbine section comprises a plurality of turbine blades configured to rotate about the centerline of the gas turbine engine, wherein at least one of the plurality of turbine blades comprises:

a plurality of cooling holes positioned adjacent a tip of the turbine blade, wherein the plurality of cooling holes comprises six cooling holes, including a first cooling hole, a second cooling hole, a third cooling hole, a fourth cooling hole, a fifth cooling hole, and a sixth cooling hole;

wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade;

wherein each of the plurality of cooling holes are offset from the tip of the turbine blade by less than 0.55% of a total span between the centerline of the gas turbine engine and the tip of the turbine blade; and wherein:

a spacing between the first cooling hole and the second cooling hole, a spacing between the second cooling hole and the third cooling hole, and a spacing between the third cooling hole and the fourth cooling hole are equal values; and a spacing between the fourth cooling hole and the fifth cooling hole is larger than the spacing between the third cooling hole and the fourth cooling hole.

16. A gas turbine engine comprising:

a compressor section, a combustor section, and a turbine section, each positioned around a centerline of the gas turbine engine, wherein the centerline is a central axis of the gas turbine engine;

the turbine section comprises a plurality of turbine blades configured to rotate about the centerline of the gas turbine engine, wherein at least one of the plurality of turbine blades comprises:

a plurality of cooling holes positioned adjacent a tip of the turbine blade;

wherein each of the plurality of cooling holes extend from an interior of the turbine blade through a turbine blade pressure-side sidewall toward a trailing edge of the turbine blade at an acute angle with respect to a vertical axis extending from a base of the turbine blade to the tip of the turbine blade;

wherein each of the plurality of cooling holes are offset from the tip of the turbine blade by less than 0.55% of a total span between the centerline of the gas turbine engine and the tip of the turbine blade; and wherein the plurality of cooling holes are located in the turbine blade according to coordinates of Table 2, wherein the coordinates of Table 2 are non-dimensional zed distances from a point of origin within the gas turbine engine based on a total span between the centerline of the gas turbine engine and the tip of the turbine blade, the point of origin being located at the centerline of the gas turbine engine and at a location an equal distance between a leading edge and a trailing edge of the turbine blade.

* * * * *